US006046420A

United States Patent [19]

DeMoss

[11] Patent Number: 6,046,420

[45] Date of Patent: Apr. 4, 2000

[54] SILICON SWITCH

[75] Inventor: David M. DeMoss, Redwood City, Calif.

[73] Assignee: Electronics for Imaging, Inc., Foster City, Calif.

[21] Appl. No.: 09/216,010

[22] Filed: Dec. 17, 1998

[51] Int. Cl.[7] ..... H01H 13/14; H01H 1/14

[52] U.S. Cl. ..... 200/534; 200/237; 200/520

[58] Field of Search ..... 200/5 A, 512–517, 200/83 N, 83 B, 534, 237, 520

[56] References Cited

U.S. PATENT DOCUMENTS

| | | | |
|---|---|---|---|
| Re. 34,095 | 10/1992 | Padula et al. | 178/18 |
| 3,717,735 | 2/1973 | Koenig | 200/85 R |
| 3,987,259 | 10/1976 | Larson | 200/5 |
| 4,345,119 | 8/1982 | Latasiewicz | 200/5 A |
| 4,618,754 | 10/1986 | Gross | 200/159 |
| 4,771,139 | 9/1988 | Desmet | 200/5 A |
| 4,786,764 | 11/1988 | Padula et al. | 178/18 |
| 5,164,558 | 11/1992 | Huff et al. | 200/512 X |
| 5,294,760 | 3/1994 | Bower et al. | 200/83 N |
| 5,298,705 | 3/1994 | Sachs | 200/513 |
| 5,413,376 | 5/1995 | Filion et al. | 280/728.3 |
| 5,561,278 | 10/1996 | Rutten | 200/5 A |
| 5,791,459 | 8/1998 | Hester et al. | 200/512 |

FOREIGN PATENT DOCUMENTS

| | | | |
|---|---|---|---|
| 0531973A2 | 3/1993 | European Pat. Off. | H01H 13/70 |
| 0531973B1 | 3/1993 | European Pat. Off. | H01H 13/70 |
| 0672981A1 | 9/1995 | European Pat. Off. | G06F 3/033 |

*Primary Examiner*—J. R. Scott
*Attorney, Agent, or Firm*—Michael A. Glenn

[57] ABSTRACT

A silicon switch is provided. A silicon member biases a contact into abutment with an opposing contact located on a substrate such that a normally closed switch is provided. A plunger is provided which has an axis that extends along the axis of the two contacts. The plunger is secured by the silicon member in such a way that pressure on the plunger causes the switch contacts to open. When pressure is released, the bias built into the silicon member pushes the contacts back together. The switch is intended for use in a pen, for example in a white board application, where pressure of the pen to a marking surface forces the plunger upwardly into the pen and thus opens the switch contacts.

10 Claims, 5 Drawing Sheets

| | |
|---|---|
| 100 | UNLESSOTHERWISE SPECIFIED, DIMENSIONS ARE IN MM AND TOLERANCES ARE: |
| 200 | X ± .5 |
| | .X ± .25 |
| | .XX ± .125 |
| | |

SILICON SWITCH

BACKGROUND OF THE INVENTION

1. Field of the Invention

The invention relates to switches. More particularly, the invention relates to an electrical switch made of silicon.

2. Description of Prior Art

Pen technology is a technology whereby a pen stylus is designed to send signals to a computer such that a digitized drawing tool for the computer is provided. A digitized drawing pen can be used for example by a professional graphic artist, by a business analyst as a presentation tool, and by a young student at home for a school project. An example of a prior art is a digitizer, which is a combination of a digital pen and a tablet. For example. M. Pladula. H. Matthews. Digitizer Stylus With Pressure Tranducer, U.S. Pat. No. 4,786,764 (Nov. 22, 1988) discloses a stylus pressure switch that is automatically activated when a tip of the stylus is pressed against a digitizer tablet with sufficient force.

Padula and Matthews discuss how data from a stylus and tablet combination in one embodiment provide input to electronic circuits, which then convert the signals into the coordinate position of the stylus on the tablet. Padula and Matthews also discuss how in another embodiment the conversion is into other signals, which in conjunction with a microprocessor are used to drive a display.

In both embodiments it is desirable that the stylus and tablet system be operative only when the stylus is intentionally pressed against the digitizer tablet surface. To obtain this level of control of the operation of the stylus and the tablet, switching elements are generally included within the stylus housing. Switching, elements can isolate the stylus from data processing circuits to eliminate spurious data inputs or can connect the stylus as required in operation. Padula and Matthews disclose a pressure switch that comprises a transducer in the form of an ink layer having electrical resistance that varies as a function of the pressure applied to the layer. Electrodes contact the ink layer transducer, providing a circuit including a variable resistance. Each electrode is formed as a layer of conductive ink. It would be advantageous to provide a switch element that is of simple design efficient, of durable material, user-friendly and economical to assemble.

Membrane switches can be simple switches. Membrane switches, according to D. Gross, Membrane Switch with Pivotable Rocker, U.S. Pat. No. 4,618,754 (Oct. 21, 1986) have been widely used for many low-voltage applications. Gross attributes the wide use in large part to the switch's simple mechanical construction and its flat front face, which allows convenient placement of descriptive graphics and which seals the switch interior from contamination. Membrane switches generally may comprise a circuit board having spaced electrical contacts fixed on its upper surface, an overlaying spacer with an aperture aligned with each contact, and a flexible membrane overlaying the spacer. An electrical contact on the underside of the membrane is normally spaced a predetermined distance above the circuit board contacts, whereby a normally open switch is provided. A downward force applied to the membrane lowers the membrane contact into electrical contact with the spaced circuit board contacts to short the latter together and thereby close the normally open switch.

The Gross Patent document discloses a membrane switch that includes a normally open set of electrical contacts and a normally closed set of electrical contacts. In one embodiment a downward force applied to the switch pivots an elongated flat rocker to close the normally open contacts and simultaneously open the normally closed contacts. When the force is removed the pivoting of the rocker is yieldably resisted by an overlaying resilient membrane that forcibly returns the rocker to its original position. In another embodiment a downward force applied to the switch lowers the center of a special disk into contact with an underlying circuit board to close the normally open contacts. The force simultaneously deforms the disk's periphery upwardly to open the normally closed contacts. When the force is removed internal stress in the deformed disk returns the disk to its original position.

Membrane switches are used in keyboard design. See for example W. Larson, Membrane Switch Apparatus Having Sequential Bridging Contact Arrangement, U.S. Pat. No. 3,987,259 (Oct. 19, 1976), W. Larson. Keyboard Membrane Switch Having Threshold Force Structure, U.S. Pat. No. 4,017,697 (Apr. 12, 1977), L. Latasiewicz, Membrane Switch Assembly With Improved Spacer, U.S. Pat. No. 4,345,119 (Aug. 17. 1982), P. Rutten, Membrane Switch, U.S. Pat. No. 5,561,278 (Oct. 1, 1996), and M. Kaizu, (Click-action membrane switch, European Patent Application No. 0 531 973 A2 (Sep. 9, 1992). In keyboard technology, the applied force to activate a switch is typically a downward force of a probe such as a finger. The force to activate a switch in a stylus housing can be an upward force reactive to the downward force of a stylus in operation.

It would be advantageous to provide a switch element that comprises the following, properties. The switch has a simple and flexible design and is economical to assemble. It is efficient, made of durable material, user-friendly and has a shape that incorporates the upward reactive force of a stylus in operation.

SUMMARY OF THE INVENTION

The preferred embodiment of the invention provides a normally closed silicon switch assembly that comprises a silicon member biasing an electrical contact located on its underside into abutment with an opposing electrical contact located on the upper surface of a lower substrate located below the silicon member. Also provided is a plunger that has an axis extending alone an axis of the two contacts. The plunger is secured by the silicon member and the lower substrate in such a way that upward pressure by the plunger causes the switch contact carried on the underside of the silicon member to separate from the switch contact carried on the lower substrate, thereby opening the switch. When the pressure is released, the bias built into the silicon member pushes the switch contact carried on the underside of the member into contact with the switch contact carried on the upper surface of the lower substrate, thereby shorting both contacts together. The silicon member has a cylindrical protruding part that presses against the upper substrate to stop the upward motion of the plunger smoothly.

In another embodiment of the invention, the silicon member can carry a plurality of contacts spaced on its underside and the lower substrate can carry a plurality of contacts spaced on its upper surface in such a way that each switch contact on the member is aligned with a switch contact on the lower substrate to provide a plurality of normally closed switches.

In yet another embodiment of the invention, the circular protruding part of the member can carry a plurality of contacts on its upper surface and the upper substrate can carry a plurality of contacts on its lower surface such that each contact of the protruding part is aligned with a contact on the upper substrate to provide a plurality of normally open switches.

In another embodiment of the invention, the plunger and the silicon member can be molded together, thereby providing a reduction in cost of assembly for production.

The preferred embodiment of the invention is for use in a marker holder. The preferred embodiment of the invention provides no noise during operation, which may otherwise distract a user. Another use of the invention is in a digital eraser that removes the markings of a digital pen. The preferred embodiment of the invention uses silicon for the member material because silicon is very pliable, survives two million or more cycles and is less susceptible to changes.

DETAILED DESCRIPTION OF INVENTION

The preferred embodiment of the invention provides a normally closed silicon switch assembly. A normally closed switch is an efficient switch because less time is required to open a closed switch than to close an opened switch. To close an opened switch, time is required for two switch contacts to become sufficiently close such that sufficient contact is made between two switch contacts thereby closing the switch. However, to open an already closed switch, less time is required to break a connection between two switch contacts thereby providing an efficient switch.

Figure 1:
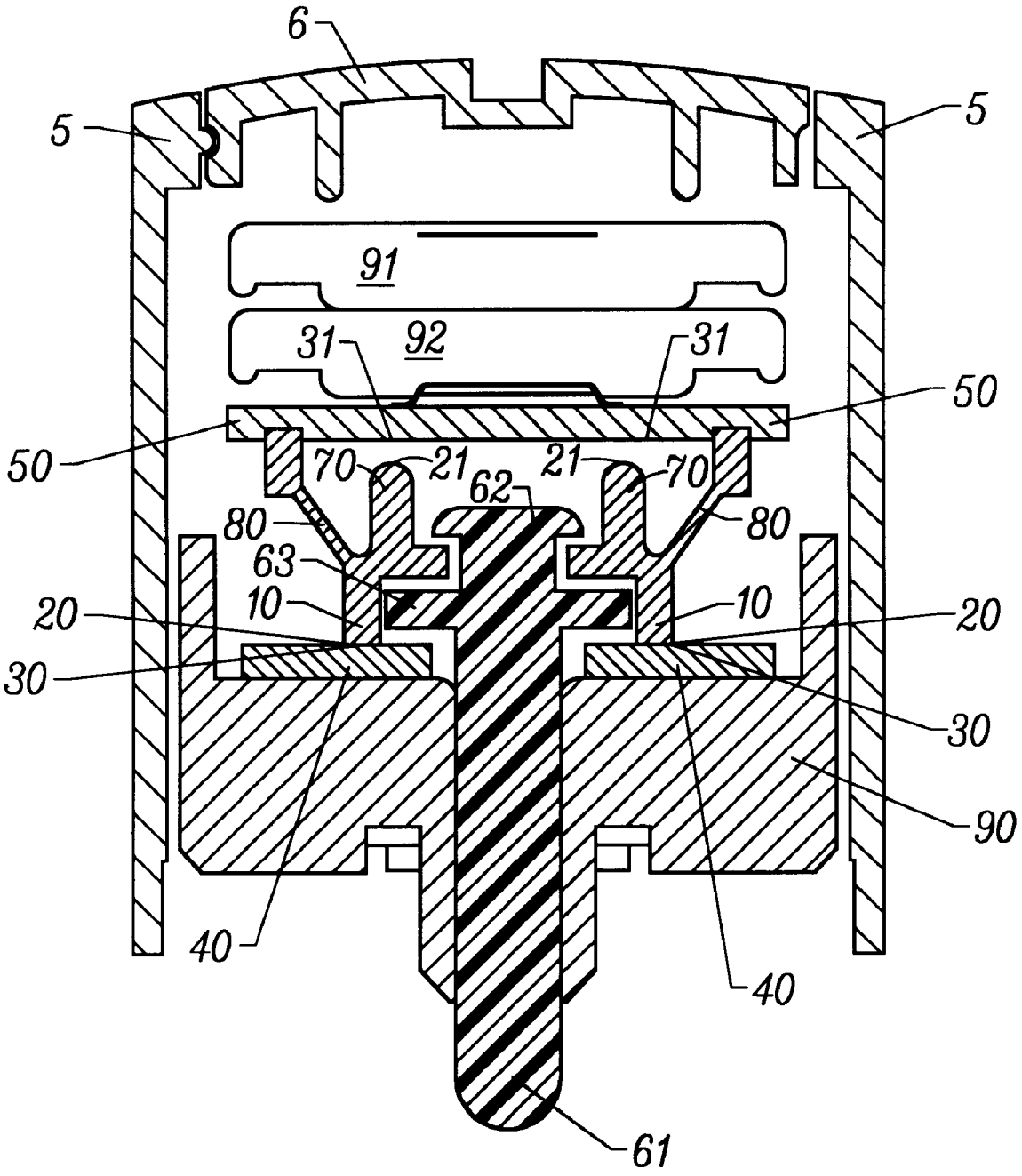
FIG. 1 is scaled drawing of a cross-sectional view of a pen housing enclosing a silicon switch.

FIG. 1 is a scaled drawing of a cross-sectional view of a pen housing 5 containing the preferred embodiment of the normally closed silicon switch. The scale is 3.000. A silicon member 10 biases an electrical contact 20 located on its underside into abutment with an opposing electrical contact 30 located on the upper surface of a substrate 40 that is below the member 10. Herein, silicon member 10 and member 10 are interchangeable. The substrate 40 is a printed circuit board (PCB). The rigid substrate 50 is also a PCB. Above the rigid substrate 50 are a first spacer element 91 and a second spacer element 92. A plunger means 60 is provided which has an axis that extends along an axis of the two contacts (20,30). Herein, plunger means 60 and plunger 60 are interchangeable. The plunger 60 comprises a tubular shaped member 61, wherein the axis of the tubular shaped member 61 extends along an axis of the first 20 and second 30 contacts. A circular lip 62 is located at a top portion of the plunger 60 such that the lip 62 overhangs a portion of the silicon member 10. The lip 62 prevents the plunger 60 from getting out of a secured position inside the silicon member 10. An extending flat disk 63 is located near the top portion of the plunger 60 and below the lip 62, such that when the plunger 60 is moving in a direction against the resting position of the silicon member 10, the disk 63 connects with the silicon member 10, thereby providing force on the silicon member 10 to move it out of its rest position. The plunger means 60 is secured by the member 10 and the lower substrate 40 in such a way that upward pressure by the plunger means 60 causes the switch contact 20 carried on the underside of the member to separate from the switch contact 30 carried on the lower substrate, thereby opening the normally closed switch. When the pressure is released, the bias built into the member 10 pushes the switch contact 20 carried on the underside of the member 10 into contact with the switch contact 30 carried on the upper side of the lower substrate, thereby shorting both contacts (20,30) together. The member 10 has a protruding part 70 that presses against the upper substrate 50 to smoothly stop the upward motion of the plunger means 60. The member 10 has a thin angular portion 80 that bellows yieldably outward when pressure is applied to the member 10. When the pressure is released the bias built into member 10 causes the thin angular part 80 to return to its resting position as shown in FIG. 1.

A switch housing 90 is shown in FIG. 1 connected to the lower substrate 40 and around a lower portion of the plunger means 60. The switch housing 90 provides a cohesive means by which the switch assembly can be easily transported, inserted into devices and removed from devices as a single unit. The switch housing 90 allows the invention to be used in a variety of situations and in a variety of devices such as for example a digital pen and a digital eraser.

Figure 1A:
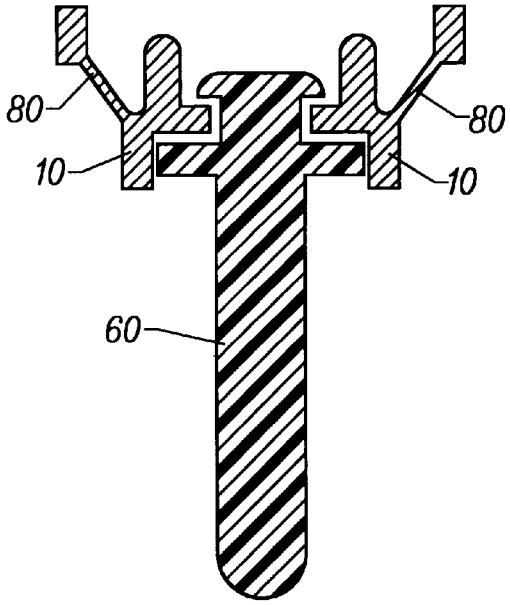
FIG. 1*a* shows an element of the claimed invention.
Figure 1B:
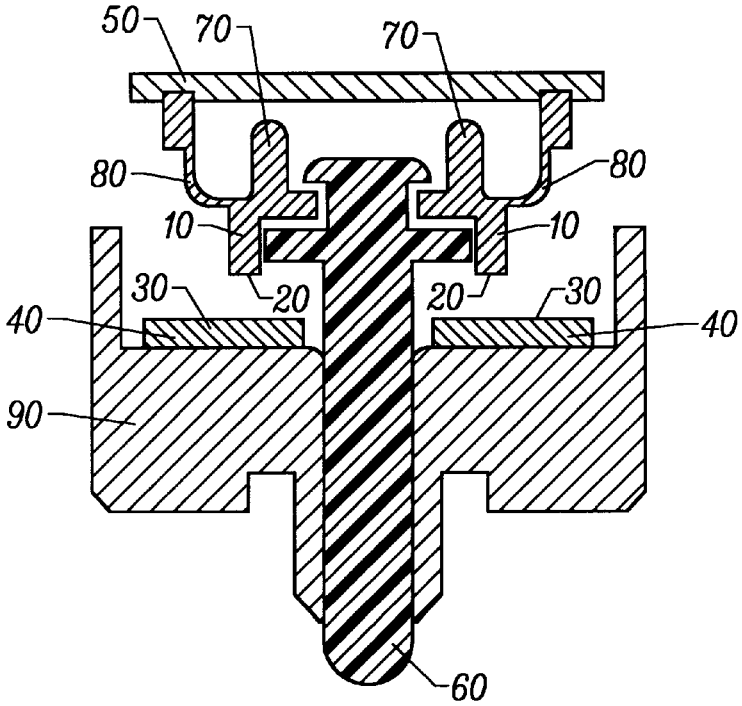
FIG. 1*b* is a cross sectional view of the silicon switch in one of its operative positions.

Referring to FIG. 1*a* a variation on a way to build the switch assembly can be modeled to have a single mold for the silicon member 10 and the plunger means 60. The entire switch assembly can be rigid except for the bellowing region 80. Having a single mold for the member 10 and the plunger means 60 is an economical alternative because having a single mold instead of two or more can reduce cost of production of the switch assembly.

The combination of the protruding part 70 and the plunger means 60 when used in a pen ensures a user-friendly device for a user. The advantage of the plunger means 60 is it incorporates the upward reactive force of a pen in operation. The plunger means works well with a pen. The shape and function of the protruding part 70 ensures that the upward reactive force is stopped in a smooth fashion and with no noise. The pen feels comfortable to the user.

Figure 2:
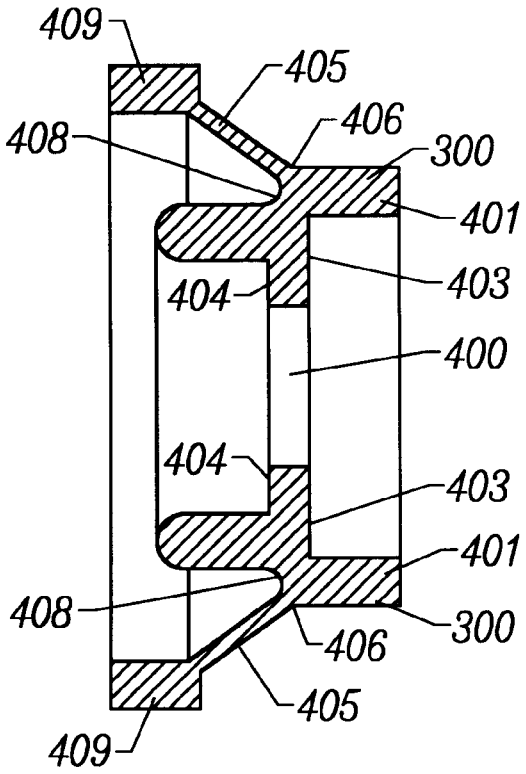
FIG. 2 is scaled drawing of a cross-sectional view of a silicon member showing dimensions of the silicon member.

FIG. 2 is a scaled drawing of a cross-sectional view of a silicon member showing dimensions 100 of the member in millimeters (mm) and tolerances 200. The scale is 4.000. The tolerance 200 for a single unit number is plus or minus five-tenths, for a number in the tenths the tolerance 200 is plus or minus twenty-five hundredths, for a number in the hundredths the tolerance 200 is plus or minus one hundred and twenty-five thousandths, and the tolerance 200 for degree measurements is plus or minus one degree.

The material used for the member 300 in the preferred embodiment of the invention is silicon rubber with durometer 40, shore A. Silicon is very pliable. Silicon is a durable material because it can survive two million cycles. Silicon is also less susceptible to changes and virtually no hysteresis.

An aperture 400 is provided for placement of a plunger means. The size of the aperture is 4.47 mm. The base of the member 401 is a solid ring such that the inner diameter of the ring 401 is 9.5 mm and the outer diameter of the ring 401 is 12 mm. A protruding part 70 is provided. The protruding part 70 also is ring shaped with a rounded top portion 70. The inner diameter of the ring shaped protruding part 70 is 7 mm and the outer diameter of the ring shaped protruding part 70 is 10 mm. A part 70 of the member 401 measured from the edge of the aperture 400 to the inner diameter of the ring shaped base of the member 401 is referred to as a ridge 403. The ridge 403 is provided by the member such that a tubular plunger means with a flat disk extending from a side of the tube placed inside the aperture can provide pressure on the member 10 when the plunger means moves against the ridge 403. A part of the member measured from the edge of the aperture to the inner diameter of the ring shaped protruding part 70 of the member provides a second ridge 404 such that a tubular plunger means with circular lip 61 at a top portion of the tube placed inside the aperture is secured. A thin angular portion 80 of the member is provided such that it bellows yieldably outward when pressure is applied to the member 10. The thickness of the angular portion 80 is 0.25 mm. The angular portion 80 extends out from the outer diameter of the first ring shaped base portion of the member 401 at an angle of 45 degrees from an axis parallel to an axis of the aperture 400. A base of the angular part 406 is 2.33 mm from the base of the member 10. A contact surface is also provided at the base of the member 10. From the base of the inner portion of the angular part 80 a dip 408 is provided to the outer portion of the base of the protruding part 70. The size of the dip 408 is 0.43 mm. The angular part is connected to a top solid ring shaped portion 409 with an inner diameter of 15 mm and an outer diameter of 17.5 mm. The length of the second ring shaped portion 409 is 2 mm. The distance from the tip of the protruding part 70 to the top portion of the top ring shaped piece 409 is 1.076 mm. The distance from the top portion of the top ring shaped piece 409 to the second ridge 404 is 3.9 mm. The distance from the base of the second ring shaped portion 409 to the base of the angular part 406 is 2.33 mm. The distance from the top most portion of the member 300 to the bottom most portion of the member 10 is 7.18 mm. The distance from the ridge 403 to the bottom most portion of the member 10 is 2.28 mm.

Figure 3:
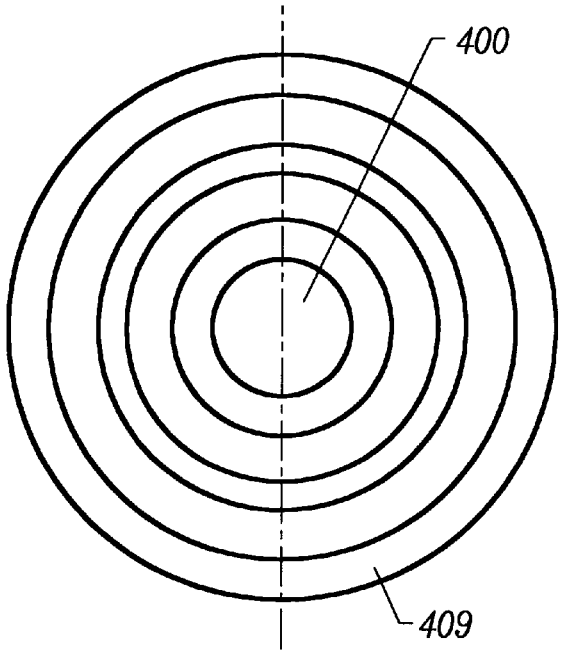
FIG. 3 is a top view of the switch of FIG. 2 showing concentric circles of radii of the switch.

FIG. 3 is a top view of the member 10 of FIG. 2 showing, concentric circles with diameters of the member 10 disclosed in FIG. 2. The diameters (in mm) of each circle taken from the inner most circle representing the aperture 400 to the outer most circle representing the top shape piece 409 are, respectively, 4.47, 7, 10, 12, 15, 17.5.

Figure 4:
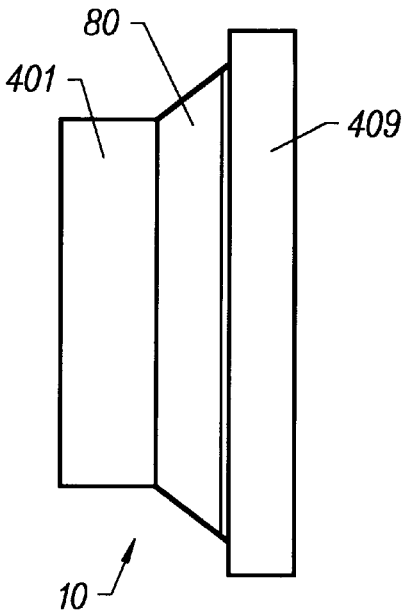
FIG. 4 is a side view of the silicon member in its normally biased position.

FIG. 4 is a side view of the outside of the silicon member 10 in its normally biased position. The member 10 comprises three prominent pieces and is funnel shaped along an axis that extends alone the three pieces. A top piece 409 is a piece that connects to a substrate and is usually rigid. A middle piece 80 is thin and bellows yieldably outward when pressure is applied to the member 10. A third piece 401 provides a base that moves up along the axis of the tunnel shaped member 10 when pressure is applied and returns downward to the normally biased position upon release of the pressure.

Figure 5B:
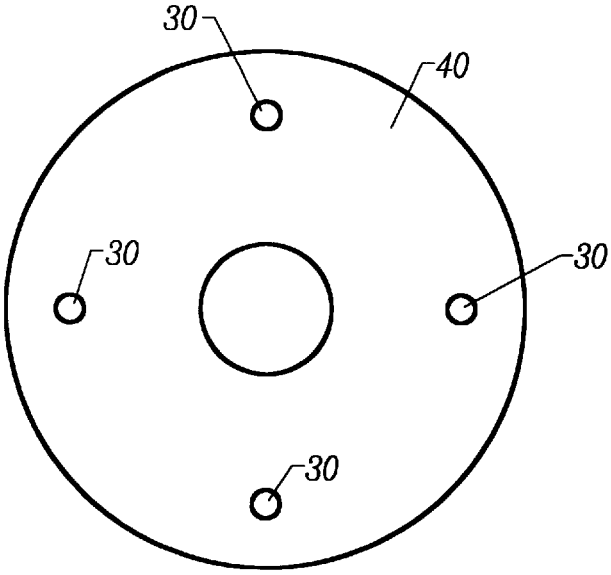
FIGS. 5*a* and 5*b* illustrate a first embodiment of the invention comprising a plurality of contacts.
Figure 5A:
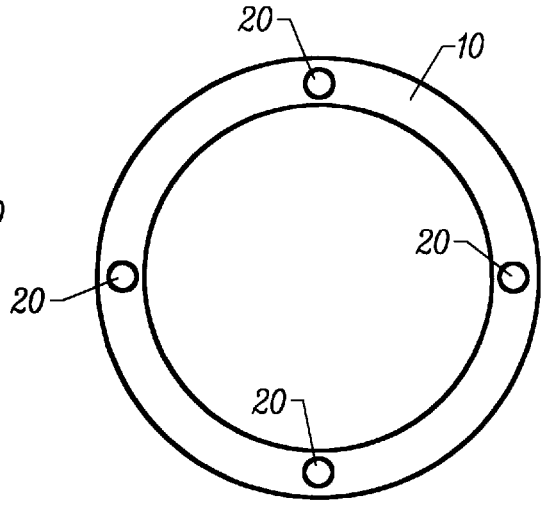
Figure 6A:
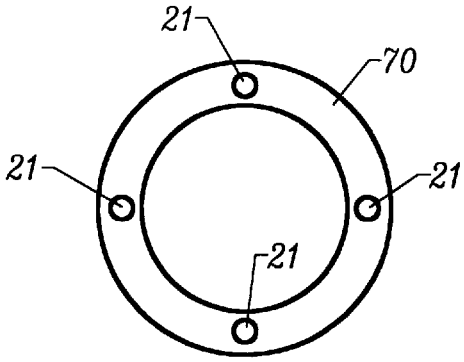
FIGS. 6*a* and 6*b* illustrate a second embodiment of the invention comprising a plurality of contacts.
Figure 6B:
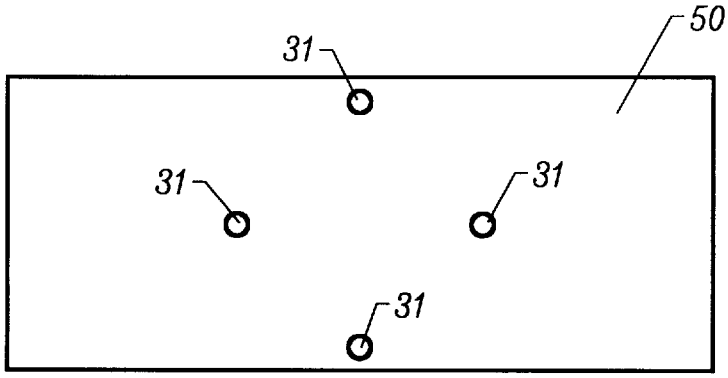

In FIGS. 5*a* and 5*b* another embodiment of the invention, is shown wherein the member 10 can carry a plurality of contacts 20 spaced on its underside and the lower substrate silicon 40 can carry a plurality of contacts 30 spaced on its upper surface such that each switch contact 20 on the member 10 is aligned with a switch contact 30 on the lower substrate 40. In FIGS. 6*a* and 6*b* another embodiment of the invention, the protruding part of the member 70 can carry a plurality of contacts 21 on its upper side and the upper substrate 50 can carry a plurality of contacts 31 on its lower side in alignment with the contacts on the protruding part such that normally open switches are provided.

The preferred embodiment of the invention lends itself to be used ideally in a pen. Other uses of the switch assembly can easily be discovered. For example, the switch assembly can be inserted into a digital eraser thereby to remove markings of a digital pen.

Accordingly, although the invention has been described in detail with reference to a particular preferred embodiment persons possessing ordinary skill in the art to which this invention pertains will appreciate that various modifications and enhancements may be made without departing from the spirit and scope of the claims that follow.

I claim:

1. A silicon switch assembly comprising:

a rigid first substrate;

a silicon member connected to said rigid first substrate, said silicon member having a resting position, said silicon member comprising a first contact located at a part of a lower region of said silicon member, an angular part;

a second substrate having a second contact located at a part of an upper region of said second substrate, whereby said second contact is in abutment with said first contact to provide a normally closed switch when said silicon member is in said resting position and to provide an opened switch when said silicon member is not in said resting position; and a plunger secured by said silicon member in such a way that pressure provided by said plunger causes said angular part of member to bellow yieldably outward, thereby causing the first contact to separate from said second contact, thereby opening said normally closed switch, and that release of the pressure causes said angular part to return to said resting position, thereby causing said second contact to return to abutment with said first contact, thereby closing said switch;

means for smoothly stopping said pressure from said plunger on said silicon member by having said protruding part come into contact with said rigid first substrate.

2. A switch as in claim 1, wherein:

said first and second contacts have electrical properties, such that when the silicon member is in the resting position the first and second contacts close an electrical circuit and such that when said plunger applies pressure to the silicon member, said electrical circuit is broken; and wherein said second substrate comprises a printed circuit board (PCB).

3. A switch as in claim 1, further comprising a normally open switch, said normally open switch having a printed circuit board (PCB), a third contact located on said PCB, a fourth contact located on the protruding part of the silicon member such that said fourth contact is aligned with said third contact, whereby pressure provided by said plunger on the silicon member causes the angular part of the silicon member to bellow yieldably outward, and thereby causes the fourth contact on the protruding part of the silicon member to come into contact with said third contact on the PCB such that the normally open switch is closed.

4. A switch as in claim 1, further comprising a plurality of contacts and a plurality of printed circuit boards (PCB's) such that a plurality of normally closed switches are provided.

5. A switch as in claim 1, wherein said plunger further comprises:

a tubular shaped member, wherein an axis of said tubular shaped member extends along an axis of said first and second contacts;

a circular lip at a top portion of said plunger such that said lip overhangs a portion of said silicon member, said lip preventing said plunger from getting out of said secured position inside the silicon member; and an extending flat disk near said top portion of said plunger and below said lip, wherein when the plunger is moving in a direction against the resting position of the silicon member, said disk connects with said silicon member, thereby providing force on the silicon member to move out of its rest position.

6. A switch as in claim 1, wherein said plunger is made of thermoplastic.

7. A switch as in claim 1, wherein said plunger is molded with said silicon member, whereby said switch is rigidly formed except for said angular part of said silicon member which bellows yieldably outward.

8. A switch as in claim 1, further comprising a switch housing, whereby said second substrate is connected to said switch housing in such a way that said switch can be transported as a single unit and inserted into or removed from various devices.

9. A switch as in claim 3, further comprising a plurality of contacts and a plurality of printed circuit boards (PCB's) such that a plurality of normally opened switches are provided.

10. A silicon switch having an axis comprising:

an aperture for placement of a plunger, said aperture having an axis wherein said switch axis is parallel to said aperture axis;

an angular portion positioned at a 45 degree angle from said parallel axis, said angular part having a thin dimension such that said angular part can yieldably bellow outward when pressure is applied;

a protruding part having a bottom portion, and a bottom part;

a ring shaped surface area at a top portion of said protruding part, and a ring shaped surface area at said bottom part of the member, wherein said ring shaped surface areas each have electrical contacts located on them; and a ridge area extending from said bottom portion of said protruding area such that said plunger is secured.

* * * * *